US010497331B2

(12) United States Patent
Hong et al.

(10) Patent No.: US 10,497,331 B2
(45) Date of Patent: Dec. 3, 2019

(54) SOURCE DRIVER, OPERATOIN METHOD THEREOF AND DRIVING CIRCUIT USING THE SAME

(71) Applicant: Novatek Microelectronics Corp., Hsinchu (TW)

(72) Inventors: Kuo-Che Hong, Hsinchu (TW); Ji-Ting Chen, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 323 days.

(21) Appl. No.: 14/558,733

(22) Filed: Dec. 3, 2014

(65) Prior Publication Data

US 2016/0078837 A1 Mar. 17, 2016

(30) Foreign Application Priority Data

Sep. 12, 2014 (TW) ..... 103131534 A

(51) Int. Cl.
*G09G 3/36* (2006.01)
*G09G 3/20* (2006.01)

(52) U.S. Cl.
CPC ..... *G09G 3/3696* (2013.01); *G09G 3/2007* (2013.01); *G09G 3/3648* (2013.01); *G09G 3/3688* (2013.01); *G09G 2300/0828* (2013.01); *G09G 2310/0291* (2013.01); *G09G 2320/0673* (2013.01); *G09G 2330/021* (2013.01)

(58) Field of Classification Search
CPC ..... G09G 3/3648; G09G 2300/0828; G09G 2330/021
See application file for complete search history.

(56) References Cited

U.S. PATENT DOCUMENTS 7,375,707 B1 * 5/2008 Lee ..... G09G 3/3648 345/89
7,388,532 B2 6/2008 Yen
7,443,369 B2 10/2008 Takahashi et al.
7,893,909 B2 2/2011 Sung
(Continued)

FOREIGN PATENT DOCUMENTS

CN 100409066 8/2008
CN 101299324 11/2008
(Continued)

OTHER PUBLICATIONS

"Office Action of Taiwan Counterpart Application", dated Nov. 16, 2015, p. 1-p. 5, in which the listed references were cited.
(Continued)

*Primary Examiner* — William Boddie
*Assistant Examiner* — Alecia D English
(74) *Attorney, Agent, or Firm* — JCIPRNET

(57) ABSTRACT

A source driver, an operation method thereof and a driving circuit using the same are provided. The source driver includes a gamma voltage generating circuit, a first voltage buffer and a reference voltage driving circuit. The gamma voltage generating circuit receives an inter reference voltage to provide a first gray level reference voltage corresponding to a first display gray level. The first voltage buffer is used for receiving the first gray level reference voltage to provide a driving voltage. The reference voltage driving circuit is coupled to the gamma voltage generating circuit and the first voltage buffer and used for accelerating rising speed or falling speed of the first gray level reference voltage.

16 Claims, 10 Drawing Sheets

(56) References Cited

U.S. PATENT DOCUMENTS

| | | | | |
|---|---|---|---|---|
| 9,001,089 | B2 | 4/2015 | Choi et al. | |
| 2004/0140985 | A1* | 7/2004 | Liaw | G09G 3/3696 345/690 |
| 2005/0024311 | A1* | 2/2005 | Takahashi | G09G 3/3688 345/89 |
| 2006/0044241 | A1 | 3/2006 | Yuh-Ren et al. | |
| 2006/0290619 | A1* | 12/2006 | Lee | G09G 3/3275 345/77 |
| 2007/0046599 | A1* | 3/2007 | Kim | G09G 3/3696 345/89 |
| 2007/0242024 | A1* | 10/2007 | Sung | G09G 3/3688 345/100 |
| 2008/0055137 | A1* | 3/2008 | Yen | H03M 1/667 341/144 |
| 2008/0309687 | A1* | 12/2008 | Choi | G09G 3/3648 345/698 |
| 2010/0141493 | A1* | 6/2010 | Cho | G09G 3/20 341/122 |
| 2011/0007019 | A1 | 1/2011 | Tasher | |

FOREIGN PATENT DOCUMENTS

| | | |
|---|---|---|
| CN | 101561991 | 10/2009 |
| CN | 101714337 | 5/2010 |
| CN | 101943977 | 12/2012 |
| TW | 200739487 | 10/2007 |
| TW | 200812250 | 3/2008 |
| TW | 201001365 | 1/2010 |

OTHER PUBLICATIONS

"Office Action of China Counterpart Application," dated Aug. 1, 2017, p. 1-p. 9, in which the listed references were Cited.

* cited by examiner

100

SOURCE DRIVER, OPERATOIN METHOD THEREOF AND DRIVING CIRCUIT USING THE SAME

CROSS-REFERENCE TO RELATED APPLICATION

This application claims the priority benefit of Taiwan application serial no. 103131534, filed on Sep. 12, 2014. The entirety of the above-mentioned patent application is hereby incorporated by reference herein and made a part of this specification.

BACKGROUND OF THE INVENTION

1. Field of the Invention

The present invention generally relates to a driver, in particular, to a source driver, an operation method thereof, and a driving circuit thereof.

2. Description of Related Art

In recent years, the consumer electronics products have been continuously developed, in which the liquid crystal display (LCD) with the properties of light and small size, less occupation of space, low radiation, low power consumption, reduced degree of generating heat, long lifetime, smooth image quality, and so on has been popularly used as the interface for the image output. In the LCD, the source driver is used to provide the image data for the LCD panel in need. The multiple data channels of the source driver would adjust the output of driving voltage according to the image data.

As stated above, when the power consumption of the source driver increases, the total power consumption of the whole LCD increases as well. Thus, it would be the essential issue for designing the source driver to reduce the power consumption of the source driver.

SUMMARY OF THE INVENTION

Accordingly, the present invention is directed to a source driver, an operation method thereof, and a driving circuit thereof, in which the static power consumption of the source driver can be reduced without influence on the operation of the source driver.

A source driver of the present invention includes a gamma voltage generating circuit, a first voltage buffer and a reference voltage driving circuit. The gamma voltage generating circuit receives an inter reference voltage to provide a first gray level reference voltage corresponding to a first display gray level. The first voltage buffer receives the first gray level reference voltage to provide a driving voltage. The reference voltage driving circuit is coupled to the gamma voltage generating circuit and the first voltage buffer to accelerate a rising speed or a falling speed of the first gray level reference voltage.

A driving circuit of the present invention, used to drive a display panel, includes a timing controller, a gamma voltage generating circuit, a first voltage buffer, a reference voltage driving circuit and a voltage selection switch. The timing controller is used to provide a display data. The gamma voltage generating circuit receives an inter reference voltage to provide a first gray level reference voltage corresponding to a first display gray level. The first voltage buffer receives the first gray level reference voltage to provide a driving voltage. The reference voltage driving circuit is coupled to the gamma voltage generating circuit and the first voltage buffer, to accelerate a recovering or a change of the voltage level of the first gray level reference voltage. A first input terminal of the voltage selection switch receives the first gray level reference voltage provided from the gamma voltage generating circuit. An output terminal of the voltage selection switch provides the first gray level reference voltage to the first voltage buffer. The voltage selection switch is conducted when a gray level corresponding to the display data is same as the first display gray level.

In an embodiment of the invention, the reference voltage driving circuit is coupled to the gamma voltage generating circuit and an input terminal of the voltage selection switch.

In an embodiment of the invention, the reference voltage driving circuit includes a second voltage buffer, of which an input terminal receives a driving reference voltage and an output terminal is coupled to the first gray level reference voltage.

In an embodiment of the invention, the source driver further includes a voltage-drop detecting circuit to detect a voltage level of the first gray level reference voltage and determine whether or not the second voltage buffer is activated.

In an embodiment of the invention, the source driver includes a data detecting circuit and determines whether or not the second voltage buffer is activated according to the display data and the first display gray level. When the gray level corresponding to the display data is same as the first display gray level, the data detecting circuit activates the reference voltage driving circuit.

In an embodiment of the invention, the second voltage buffer receives an outer control signal and is activated according to the outer control signal, and the outer control signal is at an enabling state when the display data is same as the first display gray level.

In an embodiment of the invention, the reference voltage driving circuit includes a first transistor, a first terminal of the first transistor receives a driving reference voltage, a second terminal of the first transistor is coupled to the first gray level reference voltage.

In an embodiment of the invention, a control terminal of the first transistor receives the inter reference voltage.

In an embodiment of the invention, a bulk terminal of the first transistor is coupled to the first gray level reference voltage.

In an embodiment of the invention, a control terminal of the first transistor is coupled to the first terminal of the first transistor.

In an embodiment of the invention, the reference voltage driving circuit further includes a voltage operation circuit, receiving an operation reference voltage and a control reference signal, coupling to a control terminal of the first transistor, wherein the first transistor is conducted according to the control reference signal. When the gray level corresponding to the display data is same as the first display gray level, the control reference signal is at an enabling state.

In an embodiment of the invention, the voltage operation circuit includes a first resistor and a second resistor. The first resistor is coupled between the operation reference voltage and the control terminal of the first transistor. The second resistor is coupled between the control terminal of the first transistor and the control reference signal.

In an embodiment of the invention, the reference voltage driving circuit includes a diode, coupled between a driving reference voltage and the first gray level reference voltage.

In an embodiment of the invention, the reference voltage driving circuit receives a driving reference voltage.

In an embodiment of the invention, the driving reference voltage is one of a second gray level reference voltage corresponding to a second display gray level, the inter reference voltage, and a system high voltage.

In an embodiment of the invention, the gamma voltage generating circuit includes a third voltage buffer and a resistor string. The third voltage buffer receives the inter reference voltage to generate a gamma base voltage. The resistor string receives the gamma base voltage to provide multiple gray level reference voltages, including the first gray level reference voltage, after voltage-dividing on the gamma base voltage.

In an embodiment of the invention, the reference voltage driving circuit is coupled between the gamma voltage generating circuit and the first voltage buffer.

An operation method of source driver of the present invention includes the following steps. An inter reference voltage is received by a gamma voltage generating circuit, to provide a first gray level reference voltage corresponding to a first display gray level. The first gray level reference voltage is received by a first voltage buffer, to provide a driving voltage. A rising speed or a falling speed of the first gray level reference voltage is accelerated by a reference voltage driving circuit.

In an embodiment of the invention, the operation method of source driver further includes activating the reference voltage driving circuit when a voltage difference due to falling of the first gray level reference voltage is greater than a threshold.

In an embodiment of the invention, the operation method of source driver further includes activating the reference voltage driving circuit when a voltage difference due to falling of the first gray level reference voltage is greater than a threshold or an outer control signal received by the reference voltage driving circuit is at an enabling state.

In an embodiment of the invention, the operation method of source driver further includes activating the reference voltage driving circuit when an outer control signal received by the reference voltage driving circuit is at an enabling state.

According to the foregoing descriptions, in the invention about the source driver of the invention and the operation method thereof and the driving circuit thereof, the reference voltage driving circuit accelerates the rising speed or the falling speed of the first gray level reference voltage when the first gray level reference voltage is at a transient state. Thereby, the static power consumption of the source driver can be reduced, and the operation of the source driver is not affected.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
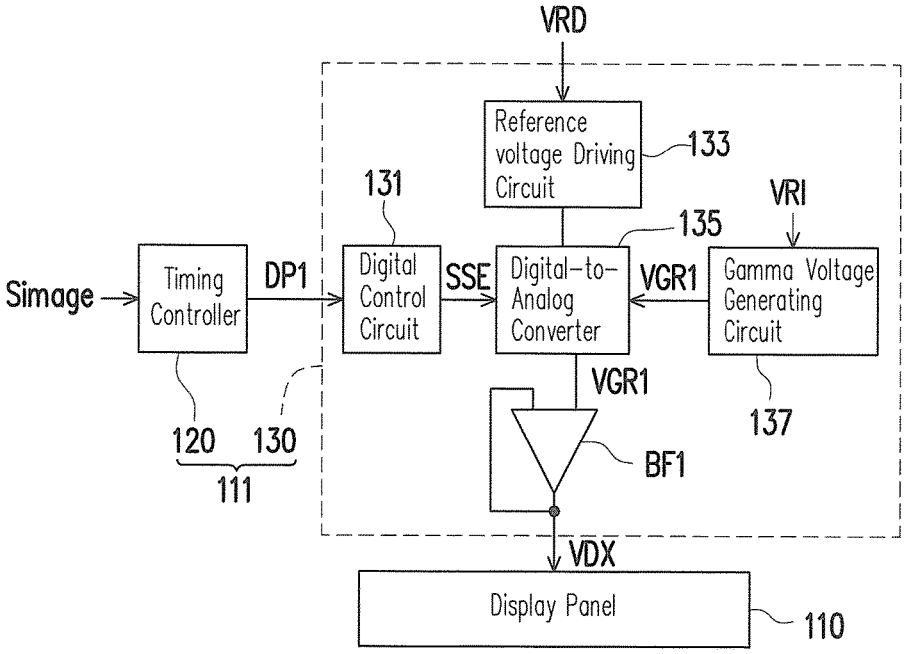
FIG. 1 is a drawing, schematically illustrating a system of displaying apparatus, according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a drawing, schematically illustrating a system of displaying apparatus, according to an embodiment of the invention. Referring to FIG. 1, in the embodiment, the displaying apparatus 100 includes display panel 110 and a driving circuit 111 for driving the display panel 110. The driving circuit 111 in an example includes a timing controller 120 and a source driver 130. The timing controller is used to receive an image signal Simage for providing the display data DP1 to the source driver 130.

The source driver 130 includes, for example, a digital control circuit 131, a reference voltage driving circuit 133, a digital-to-analog converter (DAC) 135, a gamma voltage generating circuit 137, and a first voltage buffer BF1. The gamma voltage generating circuit 137 receives an inter reference voltage VRI, to provide a first gray level reference voltage VGR1 corresponding to a first display gray level, such as one of the gray levels of 0-255. The digital control circuit 131 receives the display data DP1, to provide the voltage selection signal SSE accordingly.

The DAC 135 is coupled between the digital control circuit 131 and the gamma voltage generating circuit 137, to determine whether or not the first gray level reference voltage VGR1 is provided according to the voltage selection signal SSE. In other words, when the display data DP1 is the first display gray level corresponding to the first gray level reference voltage VGR1, the DAC 135 is controlled by the voltage selection signal SSE for providing the first gray level reference voltage VGR1. Contrarily, when the DP1 is not the first display gray level corresponding to the first gray level reference voltage VGR1, the DAC 135 is controlled by the voltage selection signal SSE for not providing the first gray level reference voltage VGR1.

The reference voltage driving circuit 133 is coupled to the DACX 135 and receives the driving reference voltage VRD to accelerate a recovering or a change of the voltage level of the first gray level reference voltage, that is, accelerate a rising speed or a falling speed of the first gray level reference voltage VGR1 at the transient state. The first voltage buffer BF1 is used to accordingly provide the driving voltage VDX to the display panel 110 after receiving the first gray level reference voltage VGR1 provided by the DAC 135. The driving reference voltage VRD can be any voltage, such as the inter reference voltage VRI, other gray level reference voltage provide by the gamma voltage generating circuit 137, or a system high voltage.

As described above, the reference voltage driving circuit 133 would operate during the period when a transient state of the first gray level reference voltage VGR1 occurs, so a dynamic current is generated but the static current would not occur. This can prevent the static current of the source driver from increasing. Thereby, the reference voltage driving circuit 133 of the embodiment can accelerate the recovering of the first gray level reference voltage VGR1 or the change of the voltage level thereof but the static current of the source driver 130 would not increase.

Figure 2:
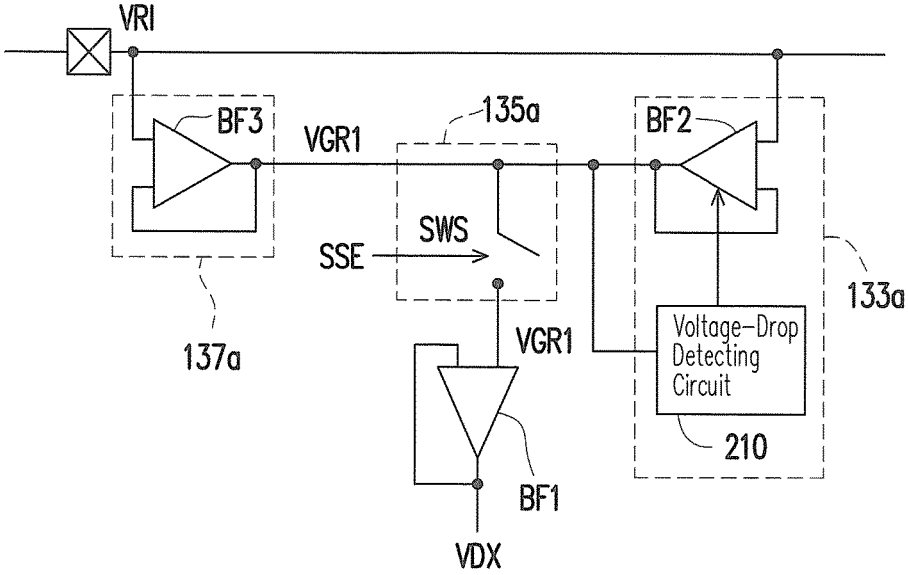
FIG. 2 is a drawing, schematically illustrating a circuit diagram of source driver, according to a first embodiment of the invention.

FIG. 2 is a drawing, schematically illustrating a circuit diagram of source driver, according to a first embodiment of the invention. Referring to FIG. 1 and FIG. 2, the same or like elements are given with the same or like reference numerals. In this embodiment, the DAC 135*a* includes, for example, the voltage selection switch SWS, wherein the input terminal of the voltage selection switch SWS receives the first gray level reference voltage VGR1 provided from the gamma voltage generating circuit 137*a*. The output terminal of the voltage selection switch SWS is used to provide the first gray level reference voltage VGR1 to the first voltage buffer BF1 and the voltage selection switch SWS is controlled by the voltage selection signal SSE for being conducted or not conducted.

The reference voltage driving circuit 133*a* in an example includes a second voltage buffer BF2 and the voltage-drop detecting circuit 210. The input terminal of the second voltage buffer BF2 receives the inter reference voltage VRI, equivalent to the driving reference voltage VRD. The output terminal of the second voltage buffer BF2 is coupled to the input terminal of the voltage selection switch SWS, equivalent to coupling to the first gray level reference voltage VGR1. In other words, the reference voltage driving circuit 133*a* is coupled to the gamma voltage generating circuit 137*a* and the input terminal of the voltage selection switch SWS.

The voltage-drop detecting circuit 210 is coupled to the second voltage buffer BF2 and the first gray level reference voltage VGR1, to detect the voltage level of the first gray level reference voltage VGR1 and to determine whether or not the second voltage buffer BF2 is activated. Further, when a voltage difference due to falling of the first gray level reference voltage VGR1 is greater than a threshold, the voltage-drop detecting circuit 210 activates the second voltage buffer BF2 to accelerate the recovering speed of the first gray level reference voltage VGR1. When the first gray level reference voltage VGR1 remains without change or the voltage difference due to falling of the first gray level reference voltage VGR1 is equal to or less than the threshold, the voltage-drop detecting circuit 210 does not activate the second voltage buffer BF2.

The gamma voltage generating circuit 137*a* in an example include a third voltage buffer BF3, to provide the first gray level reference voltage VGR1 after receiving the inter reference voltage VRI.

In addition, in the above embodiment, the input terminal of the second voltage buffer BF2 receives the inter reference voltage VRI but the input terminal of the second voltage buffer BF2 in the other embodiment can receive the other gray level reference voltage provided from the gamma voltage generating circuit 137 or the system high voltage. However, the present invention is not just limited to the embodiments.

Figure 3:
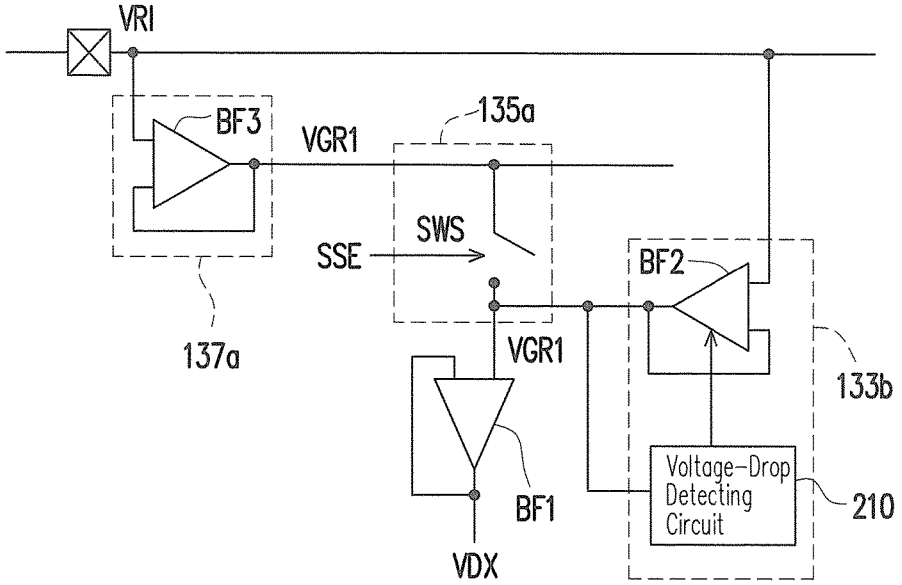
FIG. 3 is a drawing, schematically illustrating a circuit diagram of source driver, according to a second embodiment of the invention.

FIG. 3 is a drawing, schematically illustrating a circuit diagram of source driver, according to a second embodiment of the invention. Referring to FIG. 2 and FIG. 3, the same or like elements are given with the same or like reference numerals. In the embodiment, the reference voltage driving circuit 133*b* is coupled to the gamma voltage generating circuit 137*a* and the output terminal of the voltage selection switch SWS, that is, the output terminal of the second voltage buffer BF2 of the reference voltage driving circuit 133*b* is coupled to the output terminal of the voltage selection switch SWS.

Figure 4:
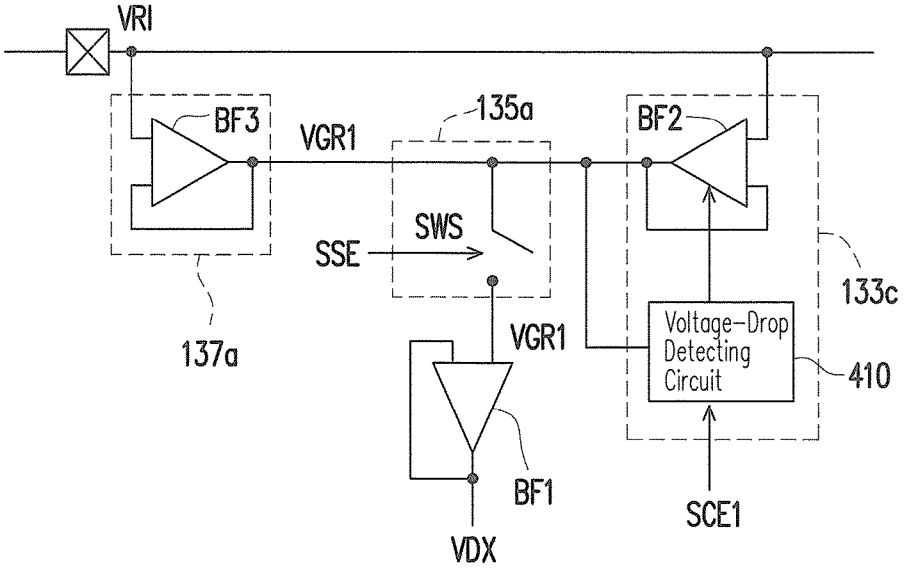
FIG. 4 is a drawing, schematically illustrating a circuit diagram of source driver, according to a third embodiment of the invention.

FIG. 4 is a drawing, schematically illustrating a circuit diagram of source driver, according to a third embodiment of the invention. Referring to FIG. 2 and FIG. 4, the same or like elements are given with the same or like reference numerals. In the embodiment, the voltage-drop detecting circuit 410 of the reference voltage driving circuit 133*c* further receives the outer control signal SCE1. In other words, the voltage-drop detecting circuit 410 detects the voltage level of the first gray level reference voltage VGR1 and to determine whether or not the second voltage buffer BF2 is activated, but also determines whether or not the second voltage buffer BF2 is activated according to the outer control signal SCE1. Further in descriptions, when a voltage difference due to falling of the first gray level reference voltage VGR1 is greater than a threshold or the outer control signal SCE1 is at an enabling state, the voltage-drop detecting circuit 410 activates the second voltage buffer BF2. When the first gray level reference voltage VGR1 remains without change or the voltage difference due to falling of the first gray level reference voltage VGR1 is equal to or less than the threshold and the outer control signal SCE1 is at a disabling state, the voltage-drop detecting circuit 410 does not activate the second voltage buffer BF2.

In an embodiment of the present invention, the outer control signal SCE1 can be provided by the timing controller 120 of the displaying apparatus 100 and the outer control signal SCE1 can be at an enabling state when the gray level corresponding to the display data DP1 received by the source driver 130 is same as the gray level corresponding to the first gray level reference voltage VGR1, that is, the first display gray level. However, in the other embodiments, the outer control signal SCE1 can be provided by any control circuit and the present invention is not limited to the embodiments.

Figure 5:
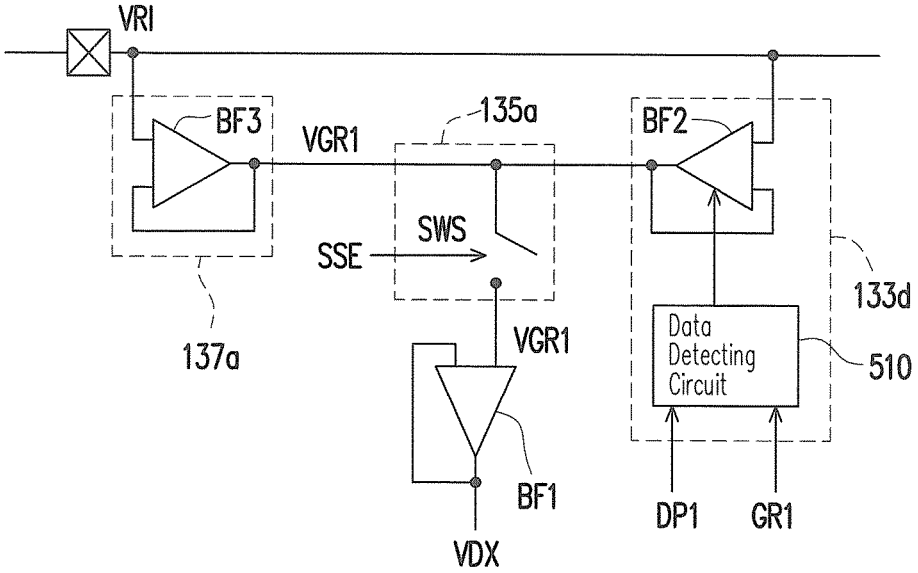
FIG. 5 is a drawing, schematically illustrating a circuit diagram of source driver, according to a fourth embodiment of the invention.

FIG. 5 is a drawing, schematically illustrating a circuit diagram of source driver, according to a fourth embodiment of the invention. Referring to FIG. 2 and FIG. 5, the same or like elements are given with the same or like reference numerals. In this embodiment, the reference voltage driving circuit 133*d* is similar to the reference voltage driving circuit 133*a*, the difference for the reference voltage driving circuit 133*d* is the data detecting circuit 510. The data detecting circuit 510 receives the display data DP1 and the gray level corresponding to the first gray level reference voltage VGR1, that is the first display gray level GR1, and determines whether or not to activate the second voltage buffer BF2 according to the display data DP1 received by the source driver 130 and the first display gray level GR1.

Further in descriptions, when the gray level of the display data DP1 is same as the first display gray level GR1, the data detecting circuit 510 activates the second voltage buffer BF2 of the reference voltage driving circuit 133*d*. When the gray level of the display data DP1 is different from the first display gray level GR1, the data detecting circuit 510 does not activate the second voltage buffer BF2.

Figure 6:
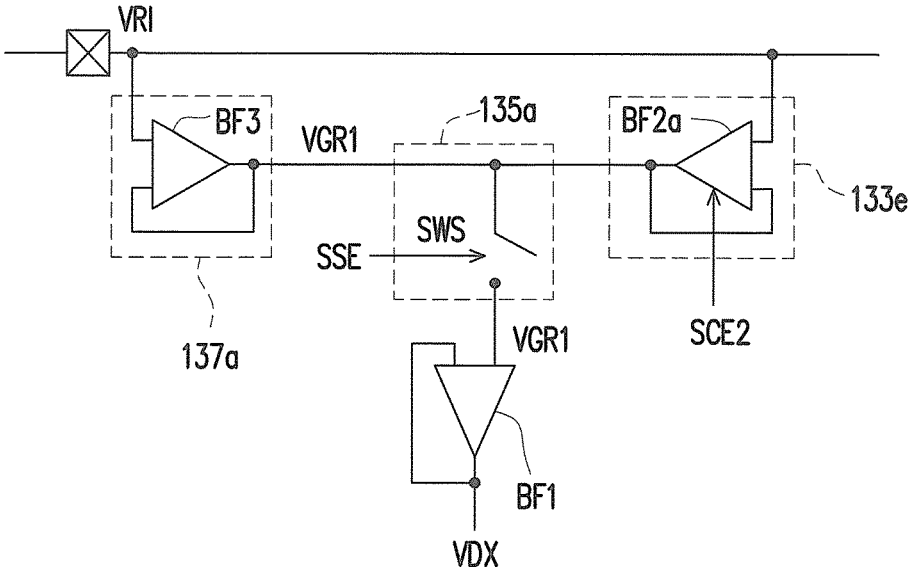
FIG. 6 is a drawing, schematically illustrating a circuit diagram of source driver, according to a fifth embodiment of the invention.

FIG. 6 is a drawing, schematically illustrating a circuit diagram of source driver, according to a fifth embodiment of the invention. Referring to FIG. 2 and FIG. 6, the same or like elements are given with the same or like reference numerals. The difference is the second voltage buffer BF2*a* of the reference voltage driving circuit 133*e*. The second voltage buffer BF2*a* receives the outer control signal SCE2, and to be activated according to the outer control signal SCE2. Further in descriptions, when the outer control signal SCE2 is at an enabling state, the second voltage buffer BF2*a* is activated. When the outer control signal SCE2 is at a disabling state, the second voltage buffer BF2*a* is not activated.

In an embodiment of the present invention, the outer control signal SCE2 can be provided by the timing controller 120 of the displaying apparatus 100, and the outer control signal SCE2 can be at an enabling state when the gray level corresponding to the display data DP1 received by the source driver 130 is same as the gray level corresponding to the first gray level reference voltage VGR1, that is, the first display gray level. However, in other embodiments, the outer control signal SCE2 can be provided by any control circuit and the present invention is not just limited to the embodiments.

Figure 7:
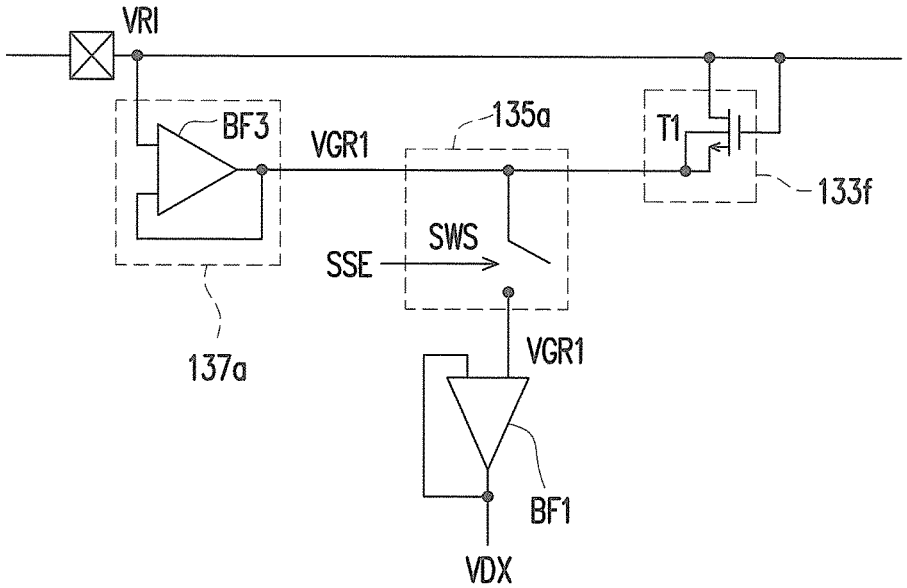
FIG. 7 is a drawing, schematically illustrating a circuit diagram of source driver, according to a sixth embodiment of the invention.

FIG. 7 is a drawing, schematically illustrating a circuit diagram of source driver, according to a sixth embodiment of the invention. Referring to FIG. 2 and FIG. 7, the same or like elements are given with the same or like reference numerals. The difference is that the reference voltage driving circuit 133*f* includes a first transistor T1. The drain terminal, corresponding to the first terminal, of the first transistor T1 receives the inter reference voltage VRI, equivalent to the driving reference voltage VRD. The source terminal, corresponding to the second terminal, of the first transistor T1 is coupled to the first gray level reference voltage VGR1. The gate terminal of the first transistor T1, corresponding to the control terminal, receives the inter reference voltage VRI. At this moment, the gate terminal of the first transistor T1 is coupled to the drain terminal.

In addition, in the embodiment, the bulk terminal of the first transistor T1 can be coupled to the first gray level reference voltage VGR1, to reduce the effect caused by the substrate of the first transistor T1. Further, in the above embodiment, the drain terminal of the first transistor T1 receives the inter reference voltage VRI. However, in the other embodiment, the drain input terminal of the first transistor T1 can receive the other gray level reference voltage provided from the gamma voltage generating circuit 137 or a system high voltage, but the present invention is not just limited to the embodiments.

Figure 8A:
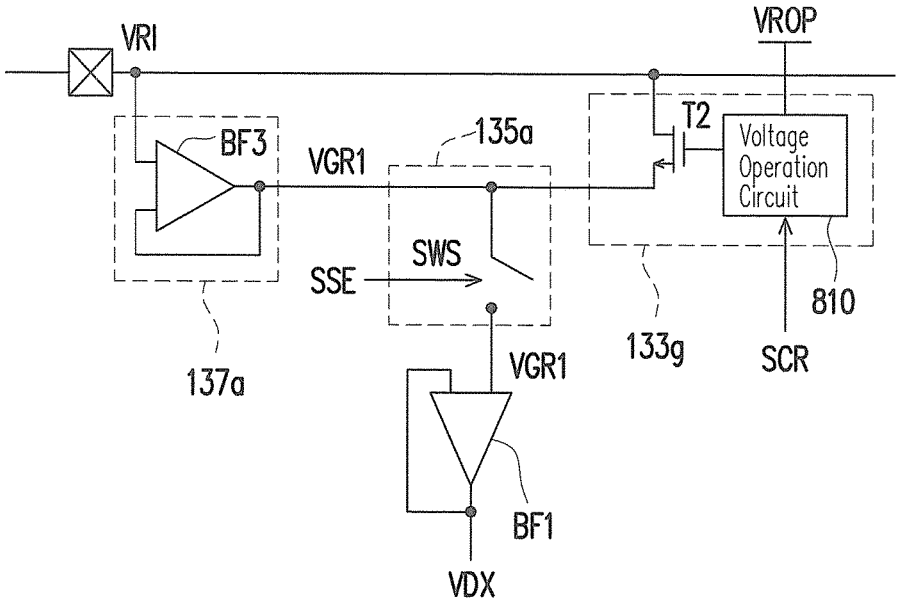
FIG. 8A is a drawing, schematically illustrating a circuit diagram of source driver, according to a seventh embodiment of the invention.

FIG. 8A is a drawing, schematically illustrating a circuit diagram of source driver, according to a seventh embodiment of the invention. Referring to FIG. 2 and FIG. 8A, the same or like elements are given with the same or like reference numerals. The difference is that the reference voltage driving circuit 133*g* includes a first transistor T2 and a voltage operation circuit 810. The drain terminal, corresponding to the first terminal, of the first transistor T2 receives the inter reference voltage VRI, equivalent to the driving reference voltage VRD. The source terminal, corresponding to the second terminal, of the first transistor T2 is coupled to the first gray level reference voltage VGR1. The gate terminal of the first transistor T2, corresponding to the control terminal, is coupled to the voltage operation circuit 810. The voltage operation circuit 810 receives an operation reference voltage VROP and a control reference signal SCR, to conduct the first transistor T2 according to the control reference signal SCR.

In the foregoing embodiment, the drain terminal first transistor T2 receives the inter reference voltage VRI. However, in the other embodiments, the drain input terminal of the of the first transistor T2 can receive the other gray level reference voltage provided from the gamma voltage generating circuit 137 or a system high voltage, but the present invention is not just limited to the embodiments. Further, the control reference signal SCR can be provided by the timing controller 120 of the displaying apparatus 100, and the control reference signal SCR can be at an enabling state when the gray level corresponding to the display data DP1 received by the source driver 130 is same as the gray level corresponding to the first gray level reference voltage VGR1, that is, the first display gray level. However, in other embodiments, the control reference signal SCR can be provided by any control circuit and the present invention is not just limited to the embodiments.

Figure 8B:
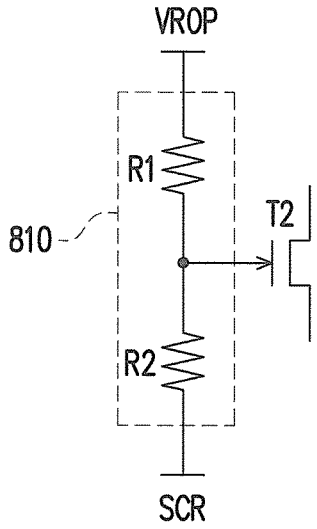
FIG. 8B is a drawing, schematically illustrating a circuit diagram of voltage operation circuit, according to an embodiment of the invention.

FIG. 8B is a drawing, schematically illustrating a circuit diagram of voltage operation circuit, according to an embodiment of the invention. Referring to FIG. 8A and FIG. 8B, the same or like elements are given with the same or like reference numerals. In the embodiment, the voltage operation circuit 810 in an example includes a first resistor R1 and a second resistor R2. The first resistor R1 is coupled between the operation reference voltage VROP and the gate terminal of the first transistor T2. The second resistor R2 is coupled between the gate terminal of the first transistor T2 and the control reference signal SCR.

Figure 9:
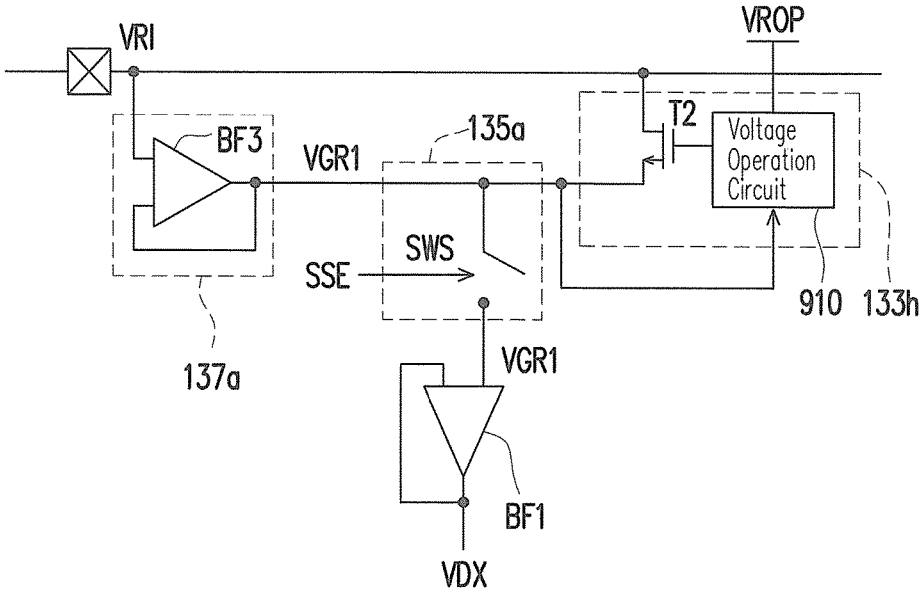
FIG. 9 is a drawing, schematically illustrating a circuit diagram of source driver, according to an eighth embodiment of the invention.

FIG. 9 is a drawing, schematically illustrating a circuit diagram of source driver, according to an eighth embodiment of the invention. Referring to FIG. 8A and FIG. 9, the same or like elements are given with the same or like reference numerals. In this embodiment, the reference voltage driving circuit 133*h* is similar to the reference voltage driving circuit 133*g*, the difference for the reference voltage driving circuit 133*h* is the voltage operation circuit 910. The voltage operation circuit 910 receives the operation reference voltage VROP and the first gray level reference voltage VGR1 and conducts first transistor T2 according to the first gray level reference voltage VGR1.

Figure 10:
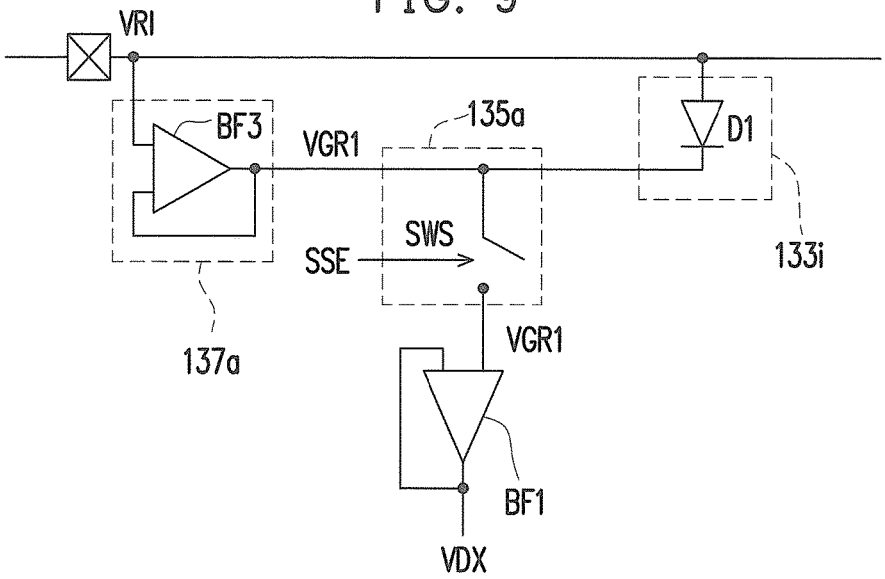
FIG. 10 is a drawing, schematically illustrating a circuit diagram of source driver, according to a ninth embodiment of the invention.

FIG. 10 is a drawing, schematically illustrating a circuit diagram of source driver, according to a ninth embodiment of the invention. Referring to FIG. 2 and FIG. 10, the same or like elements are given with the same or like reference numerals. The difference is that the reference voltage driving circuit 133*i* includes a diode D1, coupled to the inter reference voltage VRI, equivalent to the driving reference voltage VRD, and the first gray level reference voltage VGR1.

Figure 11:
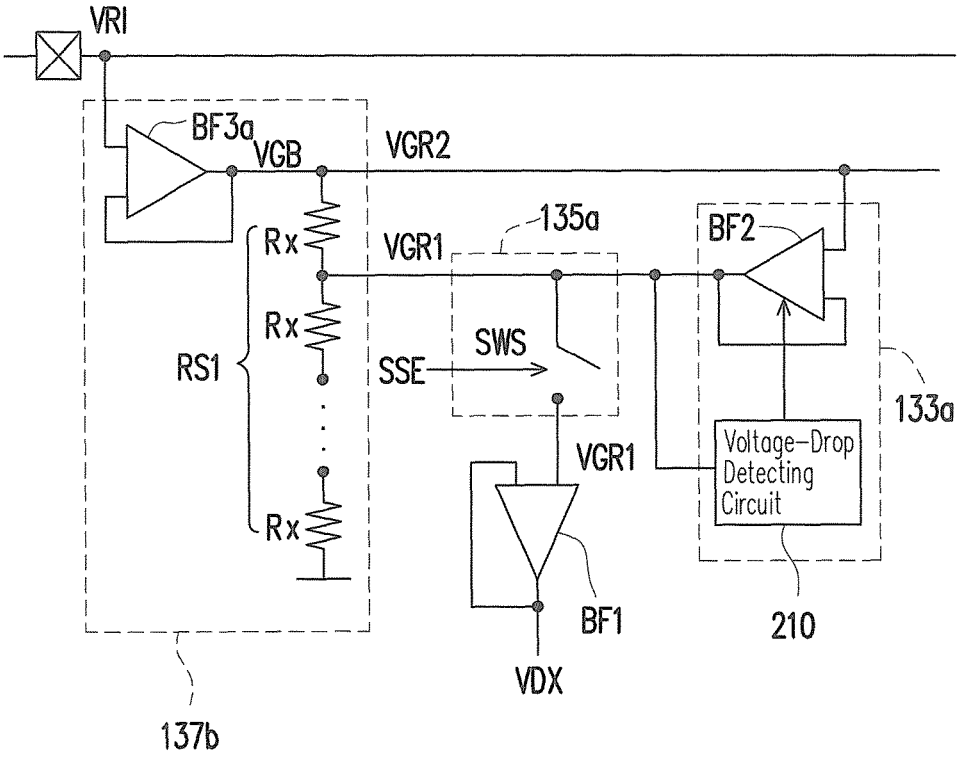
FIG. 11 is a drawing, schematically illustrating a circuit diagram of source driver, according to a tenth embodiment of the invention.

FIG. 11 is a drawing, schematically illustrating a circuit diagram of source driver, according to a tenth embodiment of the invention. Referring to FIG. 2 and FIG. 11, the same or like elements are given with the same or like reference numerals. The difference is that the gamma voltage generating circuit 137*b* further includes a resistor string RS1 composed by multiple resistors Rx. Here, the third voltage buffer BF3*a* generates a gamma base voltage VGB after receiving the inter reference voltage VRI. After the resistor string RS1 receives the gamma base voltage VGB, the resistor string RS1 divides the gamma base voltage VGB and provides multiple gray level reference voltages, such as the first gray level reference voltage VGR1 and the second gray level reference voltage VGR2. The voltage difference between the multiple gray level reference voltages provided by the resistor string RS1 can be different to one another, but the present invention is not just limited to the embodiments.

Further in the embodiment, the input terminal of the second voltage buffer of the reference voltage driving circuit 133*a* receives a second gray level reference voltage VGR2 corresponding to another display gray level, that is, the second display gray level. The second gray level reference voltage VGR2 in an example is higher than the first gray level reference voltage VGR1.

Figure 12:
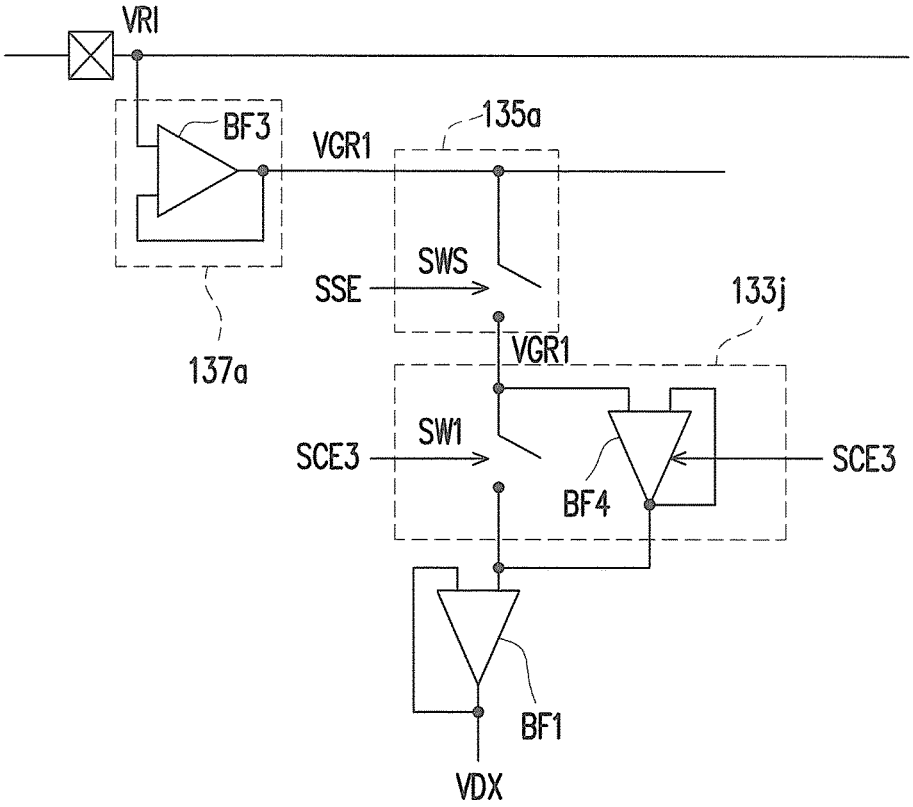
FIG. 12 is a drawing, schematically illustrating a circuit diagram of source driver, according to an eleventh embodiment of the invention.

FIG. 12 is a drawing, schematically illustrating a circuit diagram of source driver, according to an eleventh embodiment of the invention. Referring to FIG. 2 and FIG. 12, the same or like elements are given with the same or like reference numerals. In the embodiment, the reference voltage driving circuit 133*j* is coupled between the DAC 135*a* and the first voltage buffer BF1, that is, coupled between the gamma voltage generating circuit 137*a* and the first voltage buffer BF1. Further, the reference voltage driving circuit 133*j* includes a fourth voltage buffer BF4 and a first voltage switch SW1.

The input terminal of the fourth voltage buffer BF4 is coupled to the DAC 135*a* to receive the first gray level reference voltage VGR1. The output terminal of the fourth voltage buffer BF4 is coupled to an input terminal of the first voltage buffer BF1. The fourth voltage buffer BF4 receives the outer control signal SCE3 to be activated according to the outer control signal SCE3. The first voltage switch SW1 is coupled to the input terminal and the output terminal of the fourth voltage buffer BF4 in parallel, and receives the outer control signal SCE3 to be not conducted according to the outer control signal SCE3. In other words, when the fourth voltage buffer BF4 is activated, the first voltage switch SW1 is not conducted. When the fourth voltage buffer BF4 is not activated, the first voltage switch SW1 is conducted.

In an embodiment of the present invention, the outer control signal SCE3 can be provided by the timing controller 120 of the displaying apparatus 100, and the outer control signal SCE3 can be at an enabling state when the gray level corresponding to the display data DP1 received by the source driver 130 is different from the gray level corresponding to the display data DP1 previously received by the source driver 130, that is the previous display data. However in the other embodiments, the outer control signal SCE3 can be provided by any control circuit, the present invention is not just limited to the embodiments.

Figure 13:
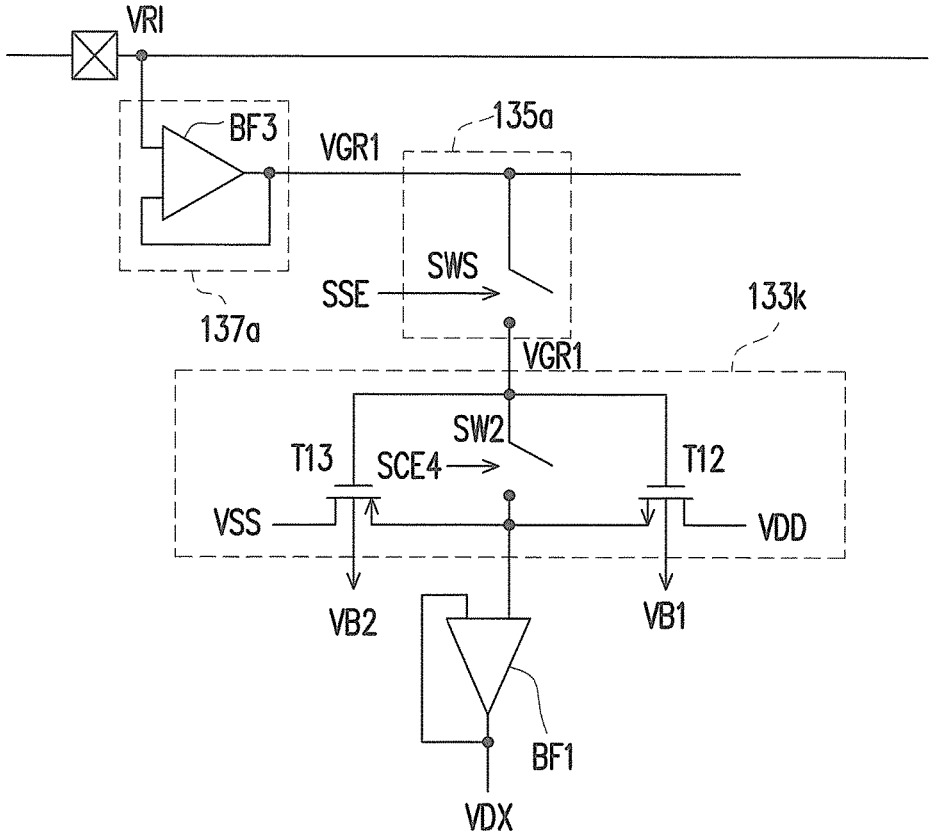
FIG. 13 is a drawing, schematically illustrating a circuit diagram of source driver, according to a twelfth embodiment of the invention.

FIG. 13 is a drawing, schematically illustrating a circuit diagram of source driver, according to a twelfth embodiment of the invention. Referring to FIG. 2 and FIG. 13, the same or like elements are given with the same or like reference numerals. In the embodiment, the reference voltage driving circuit 133*k* is coupled between the DAC 135*a* and the first voltage buffer BF1. Further, the reference voltage driving circuit 133*k* includes a second voltage switch SW2, a second transistor T12 and a third transistor T13.

The second voltage switch SW2 receives the first gray level reference voltage VGR1 to provide the first gray level reference voltage VGR1 to the input terminal of the first voltage buffer BF1 and receives the outer control signal SCE4 to be not conducted according to the outer control signal SCE4. A drain terminal, corresponding to the first terminal, of the second transistor T12 receives a system high voltage VDD, corresponding to a first driving reference voltage. A source terminal, corresponding to a second terminal, of the second transistor T12 is coupled to the input terminal of the first voltage buffer BF1. A gate terminal, corresponding to a control terminal, of the second transistor T12 receives the first gray level reference voltage VGR1. A bulk terminal of the second transistor T12 receives a first bias VB1. A drain terminal, corresponding to a first terminal, of the third transistor T13 is coupled to the input terminal of the first voltage buffer BF1. A drain terminal, corresponding to a second terminal, of the third transistor T13 receives the system low voltage VSS, corresponding to the second driving reference voltage. A gate terminal, corresponding to a control terminal, of the third transistor T13 receives the first gray level reference voltage VGR1. The bulk terminal of the third transistor T13 receives a second bias VB2.

In an embodiment of the present invention, the outer control signal SCE4 can be provided by the timing controller 120 of the displaying apparatus 100, and the outer control signal SCE4 can be at an enabling state when the gray level corresponding to the display data DP1 received by the source driver 130 is different from a display data DP1 previously received by the source driver 130, that is, the previous display data. However, in the other embodiments, the outer control signal SCE4 can be provided by any control circuit and the present invention is not limited to the embodiments.

Figure 14:
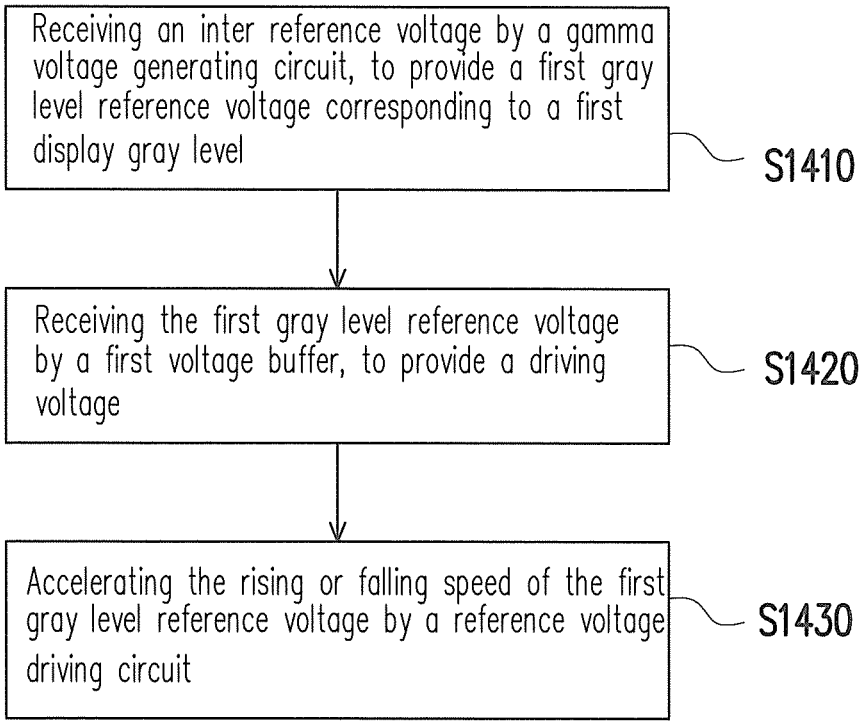
FIG. 14 is a drawing, schematically illustrating the operation method of source driver, according to an embodiment of the invention.

FIG. 14 is a drawing, schematically illustrating the operation method of source driver, according to an embodiment of the invention. Referring to FIG. 14, in the embodiment, an operation method of source driver of the present invention includes the following steps. An inter reference voltage is received by a gamma voltage generating circuit, to provide a first gray level reference voltage corresponding to a first display gray level (step S1410). The first gray level reference voltage is received by a first voltage buffer, to provide a driving voltage (step S1420). A rising speed or a falling speed of the first gray level reference voltage is accelerated by a reference voltage driving circuit (step S1430). The sequence of the steps S1410, S1420, and S1430 is for easy description, however, the present invention is not limited to this sequence. The details for the steps S1410, S1420, and S1430 can be referred to the embodiments in FIG. 1 to FIG. 13 without further descriptions.

As to the foregoing descriptions, for the source driver, the operation method and driving circuit in the embodiments of the present invention, the reference voltage driving circuit accelerates the rising speed or the falling speed of the first gray level reference voltage when the first gray level reference voltage is at a transient state. Thereby, the static power consumption of the source driver can be reduced, and the operation of the source driver is not affected.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A source driver comprising:

a gamma voltage generating circuit, receiving an inter reference voltage to provide a first gray level reference voltage corresponding to a first display gray level;

a first voltage buffer, receiving the first gray level reference voltage from the gramma voltage generating circuit to provide a driving voltage; and a reference voltage driving circuit, coupled to the gamma voltage generating circuit and the first voltage buffer, and receiving the inter reference voltage to accelerate a rising speed or a falling speed of the first gray level reference voltage by using the inter reference voltage, wherein the reference voltage driving circuit is coupled between the gamma voltage generating circuit and the first voltage buffer, wherein the gamma voltage generating circuit comprises:

a second voltage buffer, receiving the inter reference voltage to generate a gamma base voltage; and a resistor string, receiving the gamma base voltage to provide a plurality of gray level reference voltages including the first gray level reference voltage, wherein the reference voltage driving circuit comprises a third voltage buffer of which an input terminal receives a driving reference voltage and an output terminal is coupled to first gray level reference voltage, and comprises a voltage-drop detecting circuit to detect a voltage level of the first gray level reference voltage and determine whether or not the third voltage buffer is activated.

2. The source driver of claim 1, further comprising a voltage selection switch, wherein an input terminal of the voltage selection switch receives the first gray level reference voltage provided from the gamma voltage generating circuit, an output terminal of the voltage selection switch provides the first gray level reference voltage to the first voltage buffer.

3. The source driver of claim 2, wherein the reference voltage driving circuit is coupled to the gamma voltage generating circuit and the input terminal of the voltage selection switch.

4. A source driver comprising:

a gamma voltage generating circuit, receiving an inter reference voltage to provide a first gray level reference voltage corresponding to a first display gray level;

a first voltage buffer, receiving the first gray level reference voltage from the gramma voltage generating circuit to provide a driving voltage; and a reference voltage driving circuit, coupled to the gamma voltage generating circuit and the first voltage buffer, and receiving the inter reference voltage to accelerate a rising speed or a falling speed of the first gray level reference voltage by using the inter reference voltage, wherein the reference voltage driving circuit is coupled between the gamma voltage generating circuit and the first voltage buffer, wherein the gamma voltage generating circuit comprises:

a second voltage buffer, receiving the inter reference voltage to generate a gamma base voltage; and a resistor string, receiving the gamma base voltage to provide a plurality of gray level reference voltages including the first gray level reference voltage, wherein the reference voltage driving circuit comprises a third voltage buffer of which an input terminal receives a driving reference voltage and an output terminal is coupled to first gray level reference voltage, and comprises a data detecting circuit to determine whether or not the third voltage buffer is activated according to a display data received by the source driver and the first display gray level, wherein when a gray level corresponding to the display data is same as the first display gray level, the data detecting circuit activates the reference voltage driving circuit.

5. The source driver of claim 4, wherein the third voltage buffer receives an outer control signal and is activated according to the outer control signal, and the outer control signal is at an enabling state when a gray level corresponding to a display data received by the source driver is same as the first display gray level.

6. A source driver comprising:

a gamma voltage generating circuit, receiving an inter reference voltage to provide a first gray level reference voltage corresponding to a first display gray level;

a first voltage buffer, receiving the first gray level reference voltage from the gramma voltage generating circuit to provide a driving voltage; and a reference voltage driving circuit, coupled to the gamma voltage generating circuit and the first voltage buffer, and receiving the inter reference voltage to accelerate a rising speed or a falling speed of the first gray level reference voltage by using the inter reference voltage, wherein the reference voltage driving circuit is coupled between the gamma voltage generating circuit and the first voltage buffer, wherein the gamma voltage generating circuit comprises:

a second voltage buffer, receiving the inter reference voltage to generate a gamma base voltage; and a resistor string, receiving the gamma base voltage to provide a plurality of gray level reference voltages including the first gray level reference voltage, wherein the reference voltage driving circuit comprises a first transistor, wherein a first terminal of the first transistor receives a driving reference voltage, a second terminal of the first transistor is coupled to the first gray level reference voltage.

7. The source driver of claim 6, wherein a control terminal of the first transistor receives the inter reference voltage.

8. The source driver of claim 6, wherein a control terminal of the first transistor is coupled to the first terminal of the first transistor.

9. The source driver of claim 6, wherein the reference voltage driving circuit further comprises a voltage operation circuit, receiving an operation reference voltage and a control reference signal and coupling to a control terminal of the first transistor, wherein the first transistor is conducted according to the control reference signal, and the control reference signal is at an enabling state when a gray level corresponding to a display data received by the source driver is same as the first display gray level.

10. The source driver of claim 9, wherein the voltage operation circuit comprises:

a first resistor, coupled between the operation reference voltage and the control terminal of the first transistor; and a second resistor, coupled between the control terminal of the first transistor and the control reference signal.

11. A source driver comprising:

a gamma voltage generating circuit, receiving an inter reference voltage to provide a first gray level reference voltage corresponding to a first display gray level;

a first voltage buffer, receiving the first gray level reference voltage from the gramma voltage generating circuit to provide a driving voltage; and a reference voltage driving circuit, coupled to the gamma voltage generating circuit and the first voltage buffer, and receiving the inter reference voltage to accelerate a rising speed or a falling speed of the first gray level reference voltage by using the inter reference voltage, wherein the reference voltage driving circuit is coupled between the gamma voltage generating circuit and the first voltage buffer, wherein the gamma voltage generating circuit comprises:

a second voltage buffer, receiving the inter reference voltage to generate a gamma base voltage; and a resistor string, receiving the gamma base voltage to provide a plurality of gray level reference voltages including the first gray level reference voltage, wherein the reference voltage driving circuit comprises a diode, coupled between a driving reference voltage and the first gray level reference voltage.

12. A driving circuit, used for driving a display panel, comprising:

a gamma voltage generating circuit, receiving an inter reference voltage to provide a first gray level reference voltage corresponding to a first display gray level;

a first voltage buffer, receiving the first gray level reference voltage from the gramma voltage generating circuit to provide a driving voltage;

a reference voltage driving circuit, coupled to the gamma voltage generating circuit and the first voltage buffer, and receiving the inter reference voltage to accelerate a recovering or a change of a voltage level of the first gray level reference voltage by using the inter reference voltage; and a voltage selection switch, wherein an input terminal of the voltage selection switch receives the first gray level reference voltage provided from the gamma voltage generating circuit, an output terminal of the voltage selection switch provides the first gray level reference voltage to the first voltage buffer, wherein the voltage selection switch is conducted when a gray level corresponding to a display data is same as the first display gray level, wherein the reference voltage driving circuit is coupled between the gamma voltage generating circuit and the first voltage buffer, wherein the gamma voltage generating circuit comprises:

a second voltage buffer, receiving the inter reference voltage to generate a gamma base voltage; and a resistor string, receiving the gamma base voltage to provide a plurality of gray level reference voltages including the first gray level reference voltage, wherein the reference voltage driving circuit includes a third voltage buffer, of which an input terminal receives a driving reference voltage and an output terminal is coupled to the first gray level reference voltage, and comprises a voltage-drop detecting circuit, used to detect a voltage level of the first gray level reference voltage and determine whether or not the third voltage buffer is activated.

13. The driving circuit of claim 12, wherein the reference voltage driving circuit is coupled to the gamma voltage generating circuit and the input terminal of the voltage selection switch.

14. A driving circuit, used for driving a display panel, comprising:

a gamma voltage generating circuit, receiving an inter reference voltage to provide a first gay level reference voltage corresponding to a first display gray level;

a first voltage buffer, receiving the first gray level reference voltage from the gramma voltage generating circuit to provide a driving voltage;

a reference voltage driving circuit, coupled to the gamma voltage generating circuit and the first voltage buffer, and receiving the inter reference voltage to accelerate a recovering or a change of a voltage level of the first gray level reference voltage by using the inter reference voltage; and a voltage selection switch, wherein an input terminal of the voltage selection switch receives the first gray level reference voltage provided from the gamma voltage generating circuit, an output terminal of the voltage selection switch provides the first gray level reference voltage to the first voltage buffer, wherein the voltage selection switch is conducted when a gray level corresponding to a display data is same as the first display gray level, wherein the reference voltage driving circuit is coupled between the gamma voltage generating circuit and the first voltage buffer, wherein the gamma voltage generating circuit comprises:

a second voltage buffer, receiving the inter reference voltage to generate a gamma base voltage; and a resistor string, receiving the gamma base voltage to provide a plurality of gray level reference voltages including the first gray level reference voltage, wherein the reference voltage driving circuit comprises a first transistor, wherein a first terminal of the first transistor receives a driving reference voltage and a second terminal of the first transistor is coupled to the first gray level reference voltage.

15. The driving circuit of claim 14, wherein a control terminal of the first transistor receives the inter reference voltage.

16. A driving circuit, used for driving a display panel, comprising:

a gamma voltage generating circuit, receiving an inter reference voltage to provide a first gray level reference voltage corresponding to a first display gray level;

a first voltage buffer, receiving the first gray level reference voltage from the gramma voltage generating circuit to provide a driving voltage;

a reference voltage driving circuit, coupled to the gamma voltage generating circuit and the first voltage buffer, and receiving the inter reference voltage to accelerate a recovering or a change of a voltage level of the first gray level reference voltage by using the inter reference voltage; and a voltage selection switch, wherein an input terminal of the voltage selection switch receives the first gray level reference voltage provided from the gamma voltage generating circuit, an output terminal of the voltage selection switch provides the first gray level reference voltage to the first voltage buffer, wherein the voltage selection switch is conducted when a gray level corresponding to a display data is same as the first display gray level, wherein the reference voltage driving circuit is coupled between the gamma voltage generating circuit and the first voltage buffer, wherein the gamma voltage generating circuit comprises:

a second voltage buffer, receiving the inter reference voltage to generate a gamma base voltage; and a resistor string, receiving the gamma base voltage to provide a plurality of gray level reference voltages including the first gray level reference voltage, wherein the reference voltage driving circuit comprises a diode, coupled between a driving reference voltage and the first gray level reference voltage.

* * * * *